US007731177B2

(12) United States Patent
Ikeda

(10) Patent No.: US 7,731,177 B2
(45) Date of Patent: Jun. 8, 2010

(54) SHEET SUPPLYING DEVICE

(75) Inventor: Akihiro Ikeda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 291 days.

(21) Appl. No.: 11/165,116

(22) Filed: Jun. 24, 2005

(65) Prior Publication Data

US 2005/0285329 A1 Dec. 29, 2005

(30) Foreign Application Priority Data

Jun. 25, 2004 (JP) ..... 2004-188440

(51) Int. Cl.
*B65H 3/52* (2006.01)

(52) U.S. Cl. ..... 271/121; 271/122; 271/124

(58) Field of Classification Search ..... 271/121, 271/122, 167

See application file for complete search history.

(56) References Cited

U.S. PATENT DOCUMENTS

| | | | | |
|---|---|---|---|---|
| 5,527,029 | A | 6/1996 | Bortolotti et al. | |
| 5,938,355 | A | 8/1999 | Suzuki et al. | |
| 5,975,518 | A | 11/1999 | Wakana | |
| 6,371,477 | B1 * | 4/2002 | Lin | 271/121 |
| 6,467,767 | B2 * | 10/2002 | Yano | 271/122 |
| 6,616,138 | B2 * | 9/2003 | Tanaka | 271/124 |
| 6,956,679 | B2 | 10/2005 | Hatano | |
| 7,100,914 | B2 * | 9/2006 | Ramos | 271/121 |
| 2002/0060396 | A1 | 5/2002 | Tanaka | |
| 2003/0062668 | A1 | 4/2003 | Shibata | |

FOREIGN PATENT DOCUMENTS

| | | | |
|---|---|---|---|
| JP | 06144618 | A * | 5/1994 |
| JP | 7247033 | A | 9/1995 |
| JP | 9309638 | A | 12/1997 |
| JP | 10-101241 | | 4/1998 |
| JP | 2000-038230 | A | 2/2000 |
| JP | 2002-104681 | A1 | 4/2002 |

OTHER PUBLICATIONS

Notification for Reasons of Rejection dated Jan. 16, 2007 in Application No. JP2004-188440 and English translation thereof.

* cited by examiner

*Primary Examiner*—Patrick Mackey
*Assistant Examiner*—Luis Gonzalez
(74) *Attorney, Agent, or Firm*—Banner & Witcoff, Ltd

(57) ABSTRACT

A sheet supplying device for an imaging apparatus is provided with a sheet tray configured to mount a plurality of sheets in a stacked state. The sheet tray is inclined such that leading ends of the plurality of sheets are lower than trailing ends thereof. Further provided is a feed roller that faces an uppermost sheet of the plurality of sheets mounted on the sheet tray to be press-contacted thereto. The feed roller is driven to rotate to feed the uppermost sheet. Further provided is a sheet guide mechanism having at least one guiding section provided in front of the feed roller. The guiding section is inclined such that the leading ends of the plurality of sheets are moved toward the feed roller by their own weight. The guiding section is configured such that the degree of inclination of the guiding section varies depending on the amount of the plurality of sheets.

15 Claims, 10 Drawing Sheets

SHEET SUPPLYING DEVICE

CROSS-REFERENCE TO RELATED APPLICATION

This application claims priority from Japanese Patent Application No. 2004-188440, filed on Jun. 25, 2004, the entire subject matter of the application is incorporated herein by reference.

BACKGROUND

1. Technical Field

Aspects of the invention relate to sheet supplying device employed in an imaging device such as a printing device (e.g., a printer, a facsimile device, a multi function peripheral, etc.) or a scanning device for supplying sheets one by one in the imaging device.

2. Related Art

Conventionally, a sheet supplying device has been known and widely used. Such a sheet supplying device is typically configured such that a plurality of sheets are stacked on a sheet tray, and an upper surface of a leading end side portion of stacked sheets are press-contacted with a sheet feed roller. The sheet feed roller rotates to feed the recording sheet one by one in the imaging device. In such a conventional sheet supplying device, the upper surface of the stacked sheet should be press-contacted to the sheet feed roller regardless of the amount of the stacked sheets. In order to ensure the contact, the sheet tray is made movable toward and away from the sheet feed roller, and is biased toward the sheet feed roller using a spring or the like. In such a conventional configuration, room is required that allows the sheet tray, which has a substantially same size of the recording sheets, to move within a certain movable range. Obstacles have been encountered in providing desired room while downsizing the device.

To deal with the above drawback, Japanese Patent Provisional Publication No. HEI 10-101241 discloses a sheet supplying device, which is configured as follows. A stack of sheets is placed on a sheet tray such that the leading end portion of the stack of sheets is oriented toward a lower front side, and the leading end side of the stacked sheets is in contact with a support unit. The support unit in this publication is configured such that the recording sheets are movable toward the feed roller by means of their own weight. That is, stack of the recording sheets is moved toward the feed roller and is press-contacted thereto. With the configuration described in the publication, it is unnecessary to provide a room that allows the sheet tray to move. Thus, the entire device can be downsized.

According to the configuration disclosed in the publication No. HEI 10-101241, since the inclination angle of the supporting unit is fixed, when the amount of the stacked sheets is relatively large, a relatively large pressing force is applied to the feed roller by the weight of the sheets. In such a case, the plurality of sheets overlap when fed. On the other hand, if the amount of the stacked sheets is relatively small, the sheets are not press-contacted sufficiently because of their light weight, and the sheets may not be fed or fed properly by the feed roller.

SUMMARY

Aspects of the present invention are advantageous in that a sheet supplying device and/or an imaging device employing such a sheet supplying device is provided, which makes it possible to supply sheets stacked on a sheet tray one-by-one in a stable manner irrespective of variation of the amount of the stacked sheets, thereby enabling downsizing of the entire device.

BRIEF DESCRIPTION OF THE ACCOMPANYING DRAWINGS

DETAILED DESCRIPTION

Figure 1:
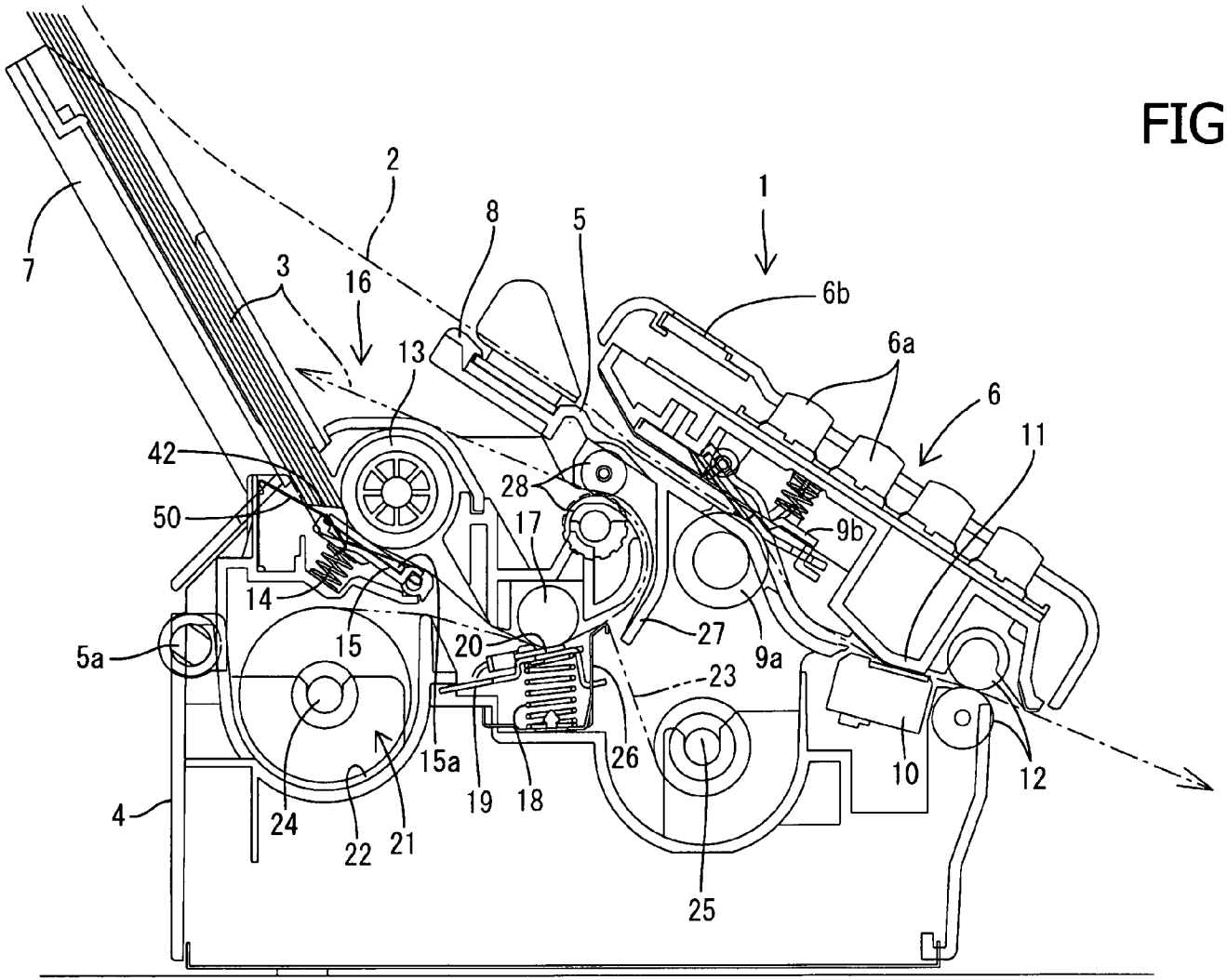
FIG. 1 is a cross-sectional side view schematically showing a configuration of a facsimile device according to an embodiment of the invention.

General Overview of Aspects of the Invention

The following describes general aspects of the invention that may or may not be included in various embodiments/modifications. Also, it is noted that various connections are set forth between elements in the following description. It is noted that these connections in general and, unless specified otherwise, may be direct or indirect and that this specification is not intended to be limiting in this respect.

According to some aspects of the invention there is provided a sheet supplying device for an imaging apparatus. The sheet supplying device is provided with a sheet tray configured to mount a plurality of sheets in a stacked state, the sheet tray being inclined such that leading ends, in a sheet feed direction, of the plurality of sheets are lower than trailing ends of the plurality of sheets, a feed roller that faces an uppermost sheet of the plurality of sheets mounted on the sheet tray to be press-contacted to the uppermost sheet, the feed roller being driven to rotate to feed the uppermost sheet, and a sheet guide mechanism having at least one guiding section provided in front of the feed roller, the guiding section extending in the sheet feed direction, the guiding section being inclined such that the leading ends of the plurality of sheets are moved toward the feed roller by their own weight, the guiding section being configured such that the degree of inclination of the guiding section varies depending on the amount of the plurality of sheets so that the uppermost sheet of the sheets on the sheet tray is guided to contact the feed roller regardless of the amount of the sheets on the sheet tray.

It should be noted that the sheets may be recording sheets, OHP (Overhead Projector) sheets, etc. on which image can be formed with a printing device such as a printer, facsimile machine, copier and the like.

With the above configuration, the inclination of the guiding section is variable depending on the weight (i.e., the amount) of the sheets mounted on the tray. Specifically, the inclination of the guiding section is relatively steep when the weight (amount) of the sheets is relatively large, while the inclination is relatively gentle when the weight (amount) of the sheets is relatively small. Therefore, even if the amount of the sheets is relatively small, i.e., the weight is relatively small, it is ensured that the sheets are guided to and press-contacted to the feed roller due to the steep inclination of the guiding section. On the other hand, when the amount of the sheets is relatively large and the weight is large, the inclination of the guiding section becomes gentle. Then, the force by which the sheets are press-contacted to the feed roller is suppressed. Further, no mechanisms for urging the sheets toward the feed roller are employed. Therefore, according to the above configuration, the sheets are fed stably and downsizing of the sheet supplying device is enabled.

Optionally, the sheet guide mechanism may include a plurality of the guiding sections arranged in a sheet width direction which is a direction perpendicular to the sheet feed direction. Further, the plurality of guiding sections may include one or more pair of guiding sections all facing the feed roller. Furthermore, the plurality of guiding sections may be arranged substantially symmetrically with respect to a center, in an axial direction, of the feed roller.

With this configuration, a plurality of guiding sections are arranged in the width direction, the sheets can be further stably fed in comparison with a case where only a single guiding section is provided.

Optionally, the guiding section may include at least one plate spring having upstream side end and downstream side end in the sheet feed direction, the plate spring being inclined such that the downstream side end is lower than the upstream side end, the plate spring being supported to be rockable about the upstream side end portion thereof, and at least one guide surface provided adjacent to the plate spring, the guide surface having a gentler inclination than the plate spring, a downstream end of the guide surface overlapping with a circumferential surface of the feed roller when viewed in the axial direction of the feed roller. Further, the guide surface may be configured to be unmovable with respect to a main body of the sheet supplying device.

According to the above configuration, if the amount of the sheets is relatively small, the plate spring hardly deforms, and the leading ends of the sheets contact the plate spring. Then, the sheets are press-contacted to the feed roller in accordance with the inclination of the plate spring. If the amount of the sheets is relatively large, the plate spring elastically deforms to move downward by the weight of the sheets, and the leading ends of the sheets contact the guide surface which has a gentler inclination than the guiding section. Therefore, when the amount of the sheets is relatively large, the sheets are press-contacted to the feed roller by a relatively weak force. With this configuration, therefore, the guiding mechanism having a relatively simple structure can be realized.

Optionally, the plate spring may include a guiding portion and an extended portion, the guiding portion extending toward the feed roller, from the upstream end of the plate spring to a front of the feed roller, the leading ends of the sheets being abut to the guiding portion from the above, the extended portion connected from a downstream side end of the guiding portion and extending in a downstream side in the sheet feed direction.

With the above configuration, when a sheet is jammed and it to be withdraw in a direction opposite to the feeding direction, the extended portion engages with the feed roller and further deformation of the plate spring can be prevented. If the sheet supplying device is provided with a sheet separating pad which is configured such that a rubber member is urged toward the feed roller, the leading end of the sheet is guided by the plate spring before it reaches the sheet separation pad and then the working point of the sheet separation pad. Therefore, even if the leading end of the sheet has been curled, it can be fed smoothly.

Further, the extended portion may be bent with respect to the guiding portion such that a portion on downstream side of the extended portion is farther from the feed roller.

According to the above configuration, even if the sheet is jammed and is to be withdrawn in a direction opposite to the sheet feed direction, the sheet will not be engaged with the downstream side portion of the plate spring. Accordingly, the plate spring will not be deformed.

Still optionally, the plate spring may include a guiding portion extending toward the feed roller, from the upstream end of the plate spring to a position where the downstream end of the guide surface overlaps with the circumferential surface of the feed roller when viewed in the axial direction of the feed roller, the leading ends of the sheets being abut to the guiding portion from the above, the extended portion connected from a downstream side end of the guiding portion and extending in a downstream side in the sheet feed direction.

With this configuration, even if the amount of the sheets on the tray is very small, the sheets can be press-contacted with the feed roller by an appropriate force, which corresponds to variation of the weight of the stack of the sheets on the tray.

Optionally, the guiding section may include a restriction mechanism that engages with the downstream side portion of the plate spring to restrict a rocking movement of the plate spring such that the plate spring does not move closer to the feed roller exceeding a predetermined position which is a position the plate spring is located when no sheets are mounted on the sheet tray.

With the above configuration, when the sheet is jammed and is to be withdrawn in a direction opposite to the sheet feed direction, the sheet will not be engaged with the downstream side portion of the plate spring. Accordingly, the plate spring will not be deformed when the jammed sheet is withdrawn.

Still optionally, the guiding section may incline such that a downstream side end, in the sheet feeding direction, is lower than an upstream side end. Further, the guiding section may be configured to rock about the downstream side end thereof.

With this configuration, the guiding section rocks such that the upstream side thereof moves downward when the amount of the sheets is relatively large, while the guiding section rocks such that the inclination is gentle when the amount of the sheets is relatively large.

Alternatively, the guiding section may be configured to rock about the upstream side end thereof.

With this configuration, the guiding section rocks such that the inclination thereof is relatively large when the amount of the sheets is relatively small, while the guiding section rocks such that the inclination is gentle when the amount of the sheets is relatively large.

Still optionally, the guiding section may include a first guiding member configured to rock such that a downstream side is lowered by the weight of the sheets whose leading ends contact the first guiding member, and a second guiding member having a predetermined inclination, the leading end of the sheets contacting the second guiding member as the downstream side of the first guiding member is lowered.

According to other aspects of the invention, there is provided to an imaging device configured to at least one of read and print image on sheets, the imaging device comprising a sheet supplying device that feeds the sheets in the imaging device which is provided with a sheet tray configured to mount a plurality of sheets in a stacked state, the sheet tray being inclined such that leading ends, in a sheet feed direction, of the plurality of sheets are lower than trailing ends of the plurality of sheets, a feed roller that faces an uppermost sheet of the plurality of sheets mounted on the sheet tray to be press-contacted to the uppermost sheet, the feed roller being driven to rotate to feed the uppermost sheet, and a sheet guide mechanism having at least one guiding section provided in front of the feed roller, the guiding section extending in the sheet feed direction, the guiding section being inclined such that the leading ends of the plurality of sheets are moved toward the feed roller by their own weight, the guiding section being configured such that the degree of inclination of the guiding section varies depending on the amount of the plurality of sheets so that the uppermost sheet of the sheets on the sheet tray is guided to contact the feed roller regardless of the amount of the sheets on the sheet tray.

It should be noted that the sheets may be recording sheets, OHP (Overhead Projector) sheets, etc. on which image can be formed with a printing device such as a printer, facsimile machine, copier and the like. It should also be noted that the "imaging apparatus" may be an image reading apparatus such as a scanner and/or an image forming apparatus such as a printer.

EMBODIMENTS

Referring now to the drawings, a description will be given in detail of a facsimile device according to an illustrative embodiments of the present invention. It should be noted that the facsimile device is only an example of the imaging device and the invention can be applied to various types of apparatuses that employ the sheet supplying device.

First Embodiment

Firstly, a facsimile device 1 according to a first embodiment will be described referring to FIGS. 1-7. The facsimile device 1 is an example of an imaging device which carries out a printing operation in accordance with a thermal transfer printing method. In the following description, the right-hand side of FIG. 1 will be referred to as a front side of the facsimile device 1, and a direction in which the recording sheets 3 stacked and mounted on the sheet tray 7 are fed will be referred to as a sheet feed direction (or a sheet supplying direction).

Entire Configuration of the Facsimile Device

FIG. 1 is a cross-sectional side view of the facsimile device 1. The facsimile device 1 reads images from an original 2 and transmits the read images as facsimile data to another facsimile device through a telephone line. The facsimile device 1 also receives facsimile data transmitted by another facsimile device through a telephone line, and forms (prints out) images corresponding to the received facsimile data on the recording sheets 3.

The facsimile device 1 according to the first embodiment also has a function to receive print data from a personal computer or word processor through a printer cable or a wireless transmission means (e.g., infrared light signal) and prints out images corresponding to the received print data.

On one surface of a main casing 4 of the facsimile device 1, a handset (not shown) is provided. Above the upper portion of the main casing 4, provided is an upper cover 5, which is rotatably supported by a shaft 5*a* at a rear end of the upper surface of the main casing 4 and covers the same. On a front area of the upper surface of the upper cover 5, an operation panel 6 having key switches 6*a* and an LCD (Liquid Crystal Display) 6*b* are provided. On a rear area of the upper surface of the main casing 4, a sheet tray 7 holds a stack of recording sheets 3 in a steeply inclined status, at the rear portion of the upper cover 5. At a central position of the main casing 4, an original tray 8 is provided.

Below the operation panel 6, on the main casing 4, an original feed roller 9*a* feeds the original 2 stacked on the original tray 8 and a pressure plate 9*b* urges toward the original feed roller 9*a*. Also, a CIS (Contact Image Sensor) 10 and an original pressing plate 11 are provided above the reading face of the CIS 10. A pair of sheet discharge rollers 12 may be provided as well. In the main casing 4, below the sheet tray 7, provided are a sheet supplying mechanism 16, which includes a feed roller 13 adapted to feed the recording sheets 3 one by one from the sheet tray 7, and a sheet separation pad 15 urged by a spring 14 toward a lower part of the circumferential surface of the sheet feed roller 13. The sheet separation pad 15 is rotatably supported such that the upstream side end (in the sheet feed direction) is rockable about a downstream side end thereof. On a surface of the sheet separation pad 15, a rubber member 15*a* attached.

On the downstream side of the sheet feed mechanism 16, a roll-shaped platen 17 and a thermal head 20 are provided. The thermal head 20 is mounted on a print table 19, which is urged by a spring 18, toward a lower surface of the platen 17. Further, below the sheet feed mechanism 16, an accommodating portion 22 for accommodating the ink ribbon cartridge 21 is formed.

The ink cartridge 21 in the accommodating portion 22 is arranged such that a ribbon supplying spool 24 is located on the rear side of the main casing 4 and a ribbon winding (take-up) spool 25 is located on the front side of the main casing 4. Further, the ink ribbon cartridge 21 is inclined such that the ribbon supplying spool 24 is located at a higher position, while the ribbon winding spool 25 is located at a lower position. With this configuration, the lower part of the accommodating portion 22 is located on the lower rear side of the main casing 4. Therefore, together with the configuration of the ink ribbon cartridge 112, a relatively large room is formed in a lower rear portion of the main casing 4. In this room (i.e., the lower rear portion of the accommodating portion 22), a control circuit board (not shown) is accommodated.

The ink ribbon sheet 23 drawn from the ribbon supplying spool 24 to the ribbon winding spool 25 passes the positions of the thermal head 20 and a peak surface of the ribbon separating plate member 26 and reaches the lower portion of the circumferential surface of the ribbon winding spool 25. In this state, the ink-bearing surface of the ink ribbon sheet 23 is the upper surface. The recording sheet 3 is overlapped with the ink ribbon sheet 23 from the above (i.e., on the ink-bearing surface), when an image is printed thereon at the printing section where the recording sheet 3 is nipped between the platen 17 and the thermal head 20. After passing through the printing section, the recording sheet passes above a partition plate 27, which has a function of feeding chute, provided above the ribbon winding spool 25, the recording sheet 3 is discharged outside the front side of the main casing 4 via the discharging rollers 12. The ink ribbon sheet 23 is bent downward at the peak surface of the ribbon separating plate 26, passing below the partition plate 27, and is wound by the ribbon winding spool 25.

Configuration of the Sheet Tray and Sheet Supplying Mechanism

Figure 2:
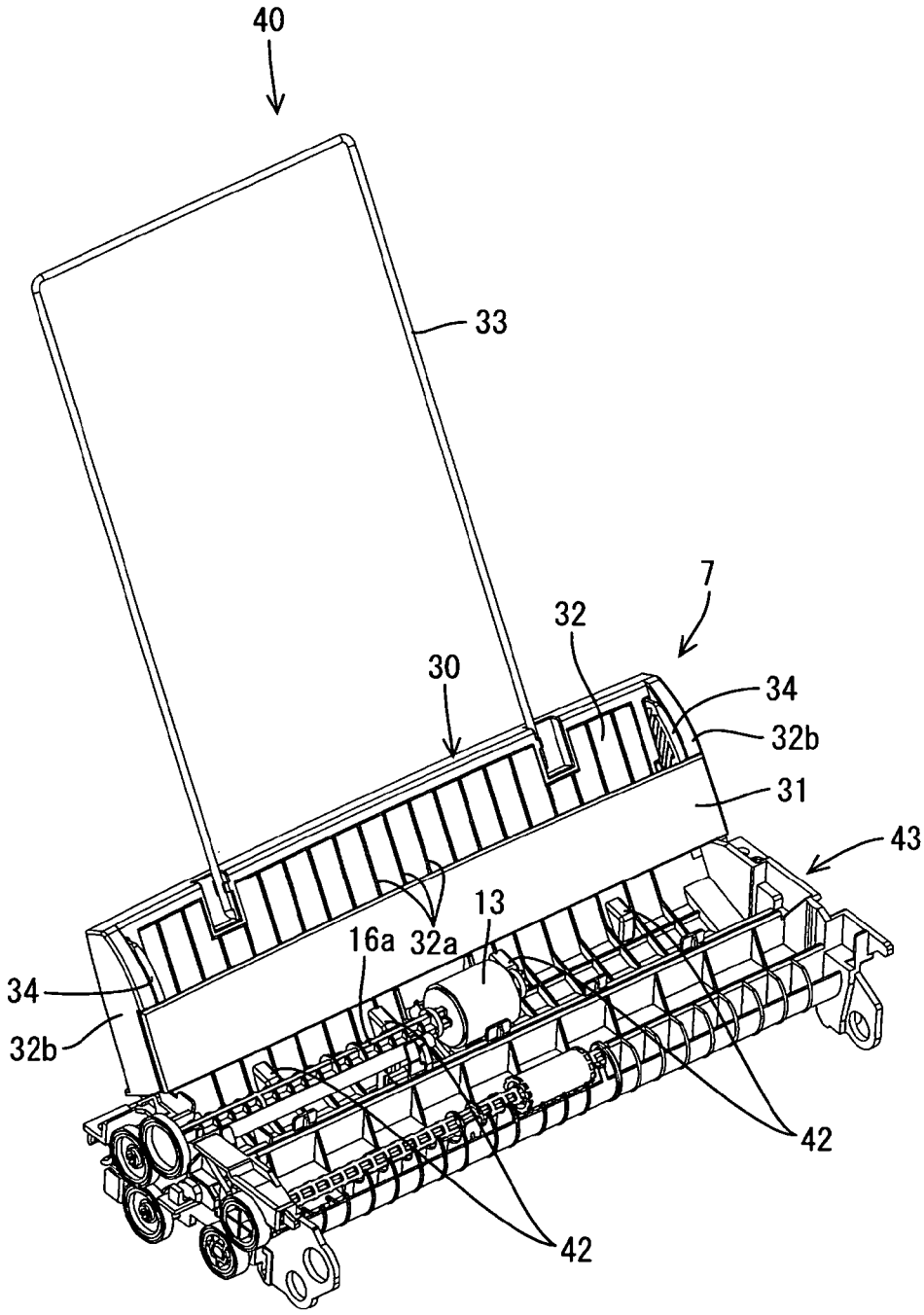
FIG. 2 is a perspective view of a sheet supplying unit of the facsimile device shown in FIG. 1 in accordance with aspects of the present invention.

Next, the sheet tray 7 and sheet supplying mechanism 16 (hereinafter, which will be referred to a sheet feed unit 40 as a whole) will be described. FIG. 2 is a perspective view showing an entire configuration of the sheet feed unit 40.

(1) Sheet Feed Tray

The sheet tray 7 mounts a plurality of recording sheets 3 in a stacked state. The stacked recording sheets 3 are oriented such that the leading ends thereof, in the sheet feed direction, are directed in an obliquely lower direction. That is, the leading ends of the recording sheets 3 are located at a lower position than the trailing ends of the recording sheets 3. The sheet tray 7 has a main body 30 and a detachably attached cover unit 31 (see FIG. 2). On the upper surface of the main body 30, at the sheet feeding part 32, a plurality of ribs 32*a* each extending in the sheet feed direction, are formed. The recording sheet 3 as fed is received on the upper surface of the ribs 32*a*. On the main body 30, a holding metal member 33 that holds a part of the recording sheet 3 is detachably coupled. On both sides of the sheet feeding part 32, in the width direction (i.e., in a direction perpendicular to the sheet feed direction), side wall portions 32*b* and 32*b*, extending in the sheet feed direction, are raised.

On the inner sides of the side wall portions 32*b* and 32*b*, a pair of guide members 34 and 34 are provided, respectively. The pair of guide members 34 and 34 are configured to be movable between a guiding position at which the guide members 34 and 34 are adjacent to the side wall portions 32*b* and 32*b* to guide the recording sheets 3, and a retracted position at which the guide members 34 and 34 are retracted (folded) on a bottom surface of the sheet feeding part 32. The sheet tray 7 is capable of mounting two types of recording sheets having different widths by setting the, guide members 34 and 34 at appropriate positions. On the lower surface of the main body 30 of the sheet tray 7, a pair of hook members (not shown) protrudes. The hook members are engaged with engaging portions 41 and 41 (see FIG. 3), thereby the sheet tray 7 is fixedly secured to the sheet feeding mechanism 16.

(2) Sheet Feed Mechanism

Figure 3:
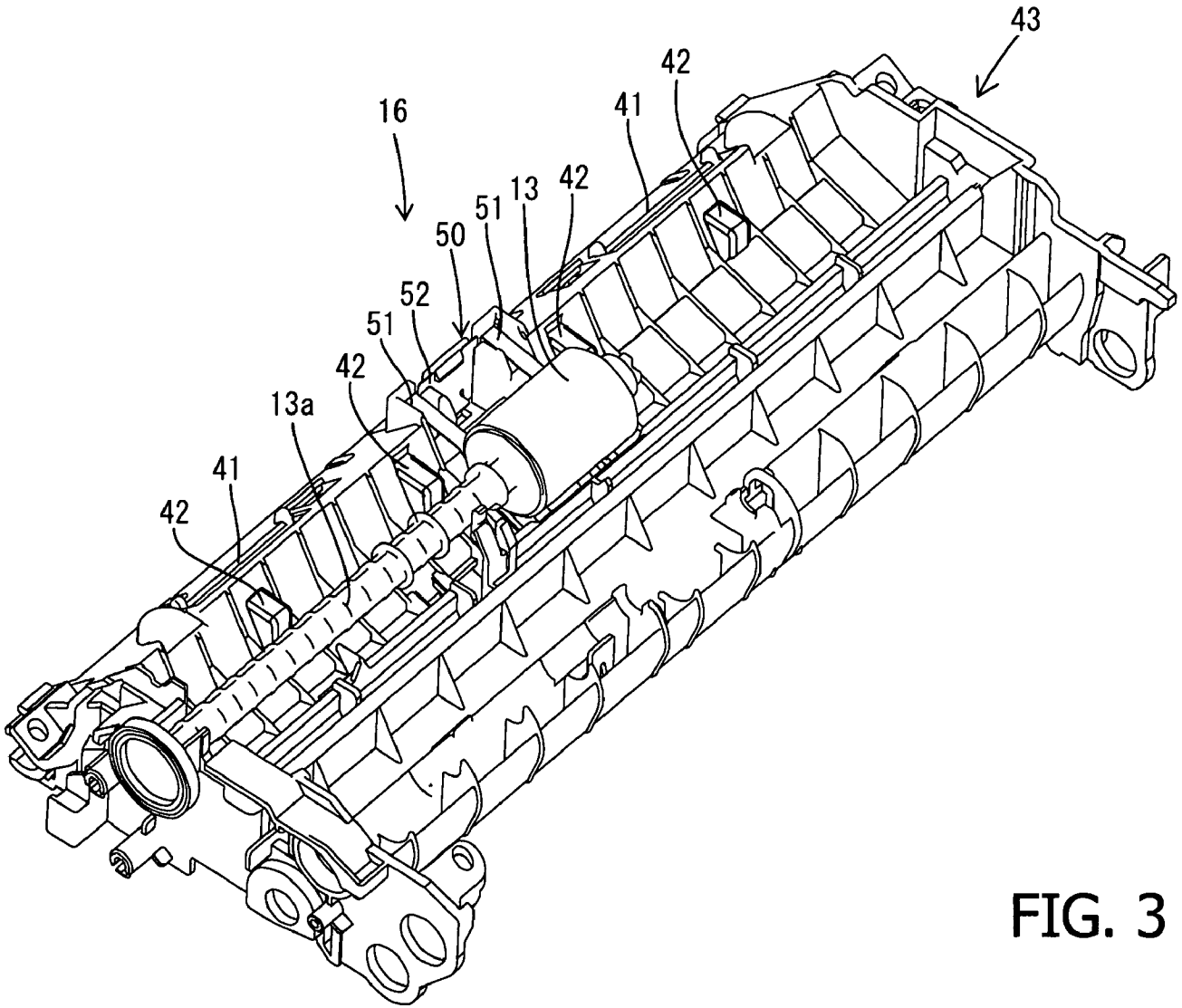
FIG. 3 is a perspective view of a sheet separating unit of the sheet supplying unit in accordance with aspects of the present invention.

FIG. 3 is a perspective view showing a sheet separating section of the sheet feed mechanism 16. As shown in FIG. 3, the sheet feed roller 13 is arranged to be next to the lower end of the sheet tray 7, when the sheet tray 7 is coupled to the sheet feed mechanism 16. The sheet feed roller 13 is driven to rotate as a driving force generated by a driving motor or driving mechanism (not shown) is transmitted through the roller shaft 13*a*. The sheet feed roller 13 feeds the recording sheets 3 one by one along the sheet feed direction. The recording sheet 3 as fed is introduced inside the facsimile device 1 as shown in FIG. 1.

The sheet feed mechanism 16 is provided with a plurality of setting units 42, which are arranged in the width direction (i.e., the direction parallel with the shaft of the sheet feed roller 13) at every predetermined interval. The upper surface 42*a* of each setting unit 42 is substantially horizontal but gently inclined, and the leading ends of the recording sheets 3 stacked on the sheet tray 7 contact the setting units 42 when the amount of the recording sheets 3 is relatively large (which will be described in detail later). According to the embodiments, the setting units 42 are arranged symmetrically with respect to the sheet feed roller 13. The height of the two setting units 42 closer to the sheet feed roller 13 is higher than that of the other (i.e., farther) two setting units 42. When viewed from a direction parallel with the rotation shaft 13*a* of the feed roller 13, the upper surfaces of the setting units 42 substantially slightly overlap with the outer circumference of the sheet feed roller 13 (see FIG. 6).

(3) Plate Spring Member

Figure 4:
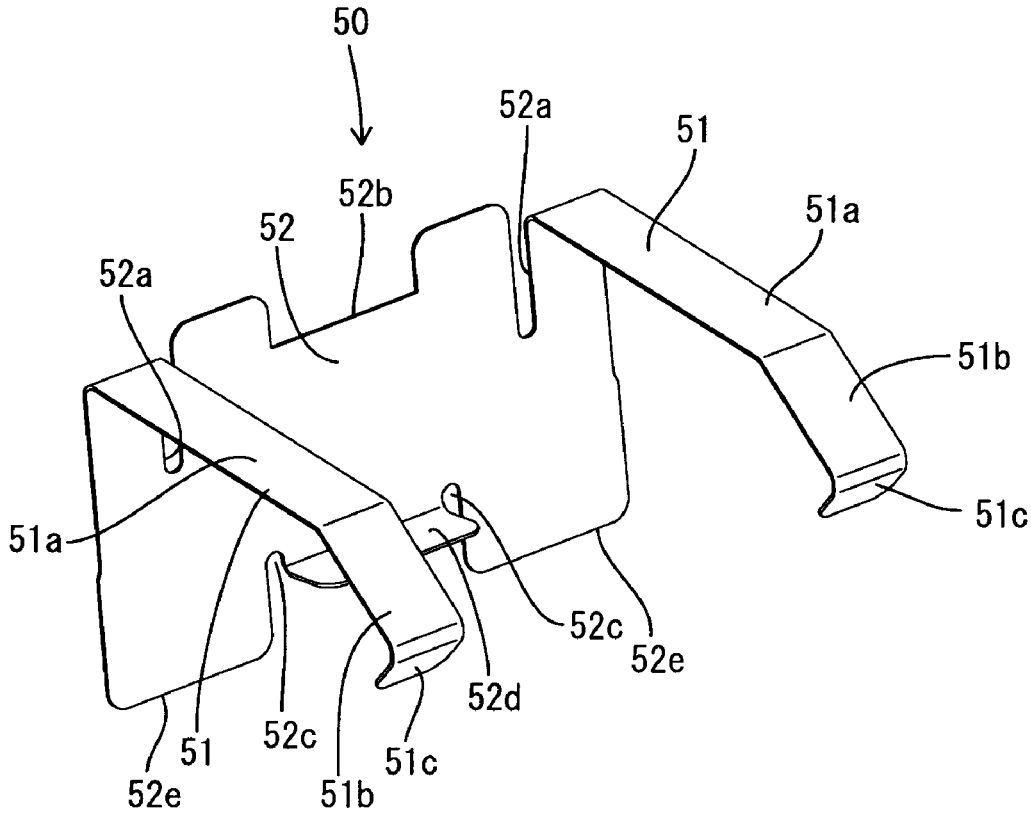
FIG. 4 is a perspective view of a pate spring member in accordance with aspects of the present invention.

According to the embodiment, the plate spring member 50 is closely arranged to face the sheet feed roller 13. By elastically deforming the plate spring member 50, an angle at which the stacked recording sheets 3 are guided toward the sheet feed roller 13 can be changed. As shown in FIG. 4, the plate spring member 50 is configured to have a pair of plate spring sections 51 and 51, and a connecting section 52 that connects the pair of plate spring sections 51 and 51, which are integrally formed as a plate spring member. For example, the plate spring member 50 may be formed by bending a single metal plate.

Figure 5:
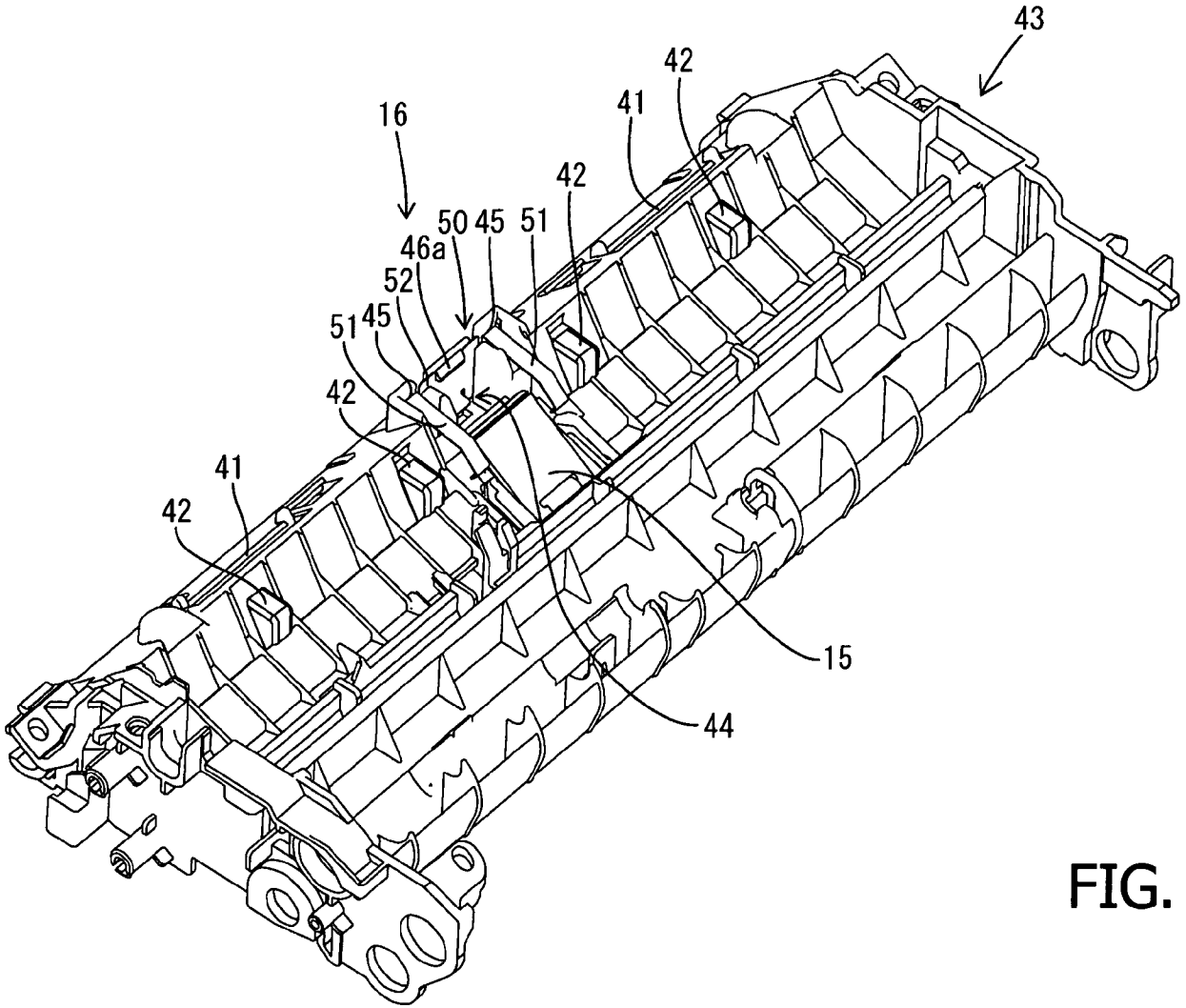
FIG. 5 is perspective view of the sheet separating unit with a feed roller being removed in accordance with aspects of the present invention.

The connecting section 52 has a substantially rectangular shape as shown in FIG. 4. The upper side of the connecting section 52 is formed with a pair of slits 52*a*, 52*a* which are formed along extended lines of the inner sides of the plate spring section 51, 51, respectively. Further, the upper side of the portion of the connecting section 52 sandwiched between the slits 52*a*, 52*a* is formed as a cut-out portion 52*b*. The lower sides of the connecting section 52 is formed with a pair of slits 52*c*, 52*c* at positions corresponding to the sides of the reentrant portion 52*b*, and a lower end portion 52*d* sandwiched between the slits 52*c*, 52*c* is bent on the same side where the plate spring sections 51, 51 extend. The plate spring member 50 formed as above is accommodated in a plate spring receiving section 44 (see FIG. 6) of the main body 4 of the sheet feed mechanism as shown in FIG. 5.

Specifically, the plate spring 50 is accommodated in the plate spring receiving section 44 with the plate spring sections 51, 51 being directed toward the downstream side in the sheet feed direction. Both ends of the connecting section 52, 52 are held by fixing grooves 45, 45 formed on the inner surface of the plate spring accommodating section 44. On the rear surface of the plate spring receiving section 44, engaging claws 46*a*, 46*b* are formed. The upper end side 52*b* of the connecting section 52 is engaged with the engaging claw 46*a*, and the lower end side 52*e* of the connecting section 52 is engaged with the engaging claw 46*b*. With this engagement, the plate spring member 50 is accurately positioned in the up-and-down direction, and fixedly secured in the plate spring receiving section 44.

As the plate spring member 50 is fixed as described above, a distal end (i.e., the downstream side end) of each of the plate spring sections 51, 51 is rotatable about its upstream side end. Each plate spring section 51 has a guide section 51*a* and an extending section 51*b*. The guide section 51*a* is inclined, from its fixed end (i.e., the upstream side end) toward the lower surface of the sheet feed roller 13 located at the obliquely downward position, at a steeper angle than an inclination angle of the upper surface 42*a* of the setting units 42. The extending section 51*b* is connected from the guide section 51*a*, extends along the sheet feed direction, and is inclined steeper than the guide section 51*a*.

Figure 6:
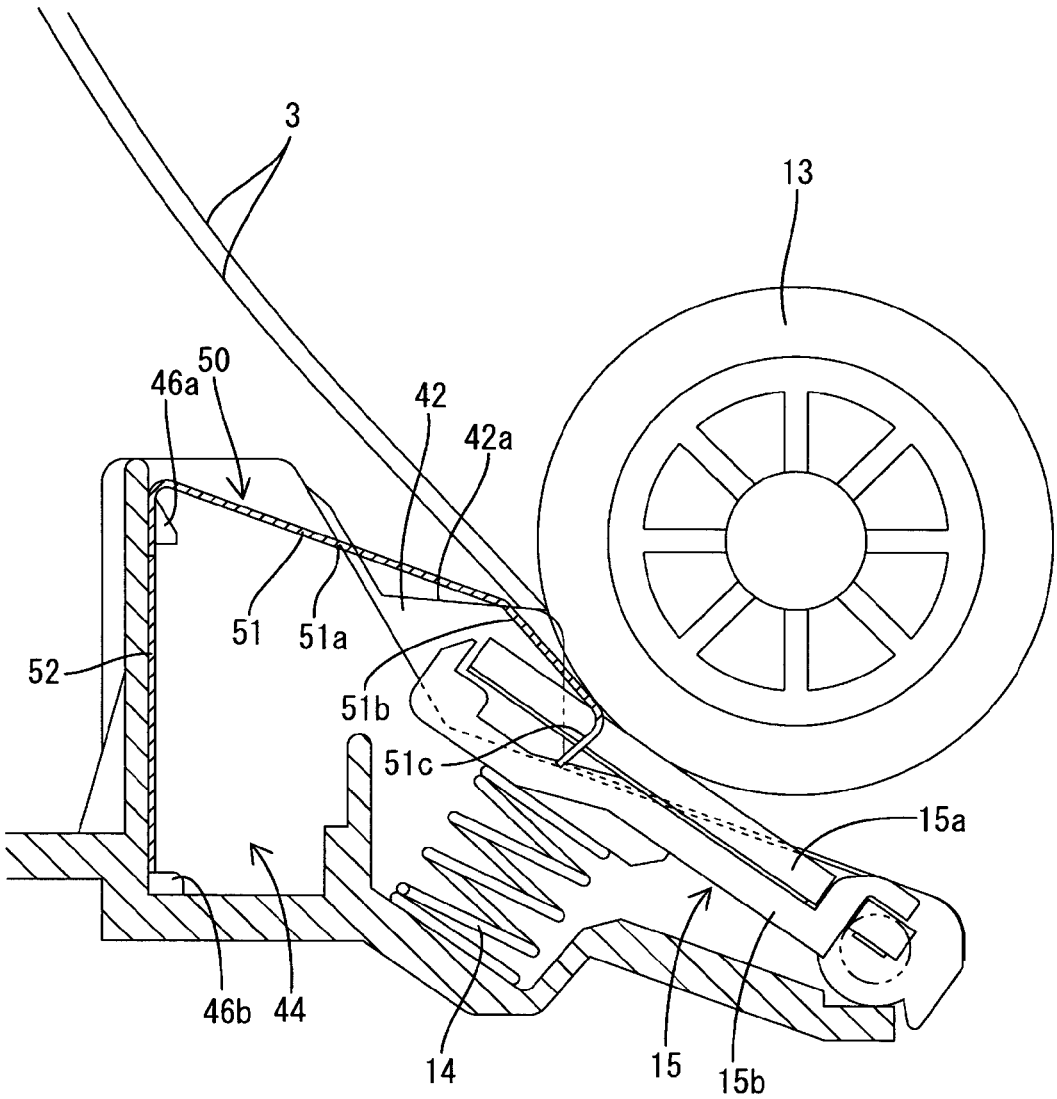
FIG. 6 is an enlarged cross-sectional view showing a status of the plate spring when the amount of stacked sheets is relatively small in accordance with aspects of the present invention.

As shown in FIG. 6, the inclination angle and length of the guide sections 51*a* are designed such that the downstream side end of the guide section 51*a* is just in front of the lower position of the circumferential surface of the feed roller 13 in the neutral state (i.e., when the weight of the recording sheet 3 is not applied) when viewed along the rotational shaft of the feed roller 13, and the downstream side end is above the upper surfaces 42*a* of the setting section 42 (or slightly overlap on the upper surfaces 42*a*). The extended section 51*b* extends such that the downstream side end is located in front of a position where the sheet feed roller 13 contacts the sheet separation pad 15. The extended section 51*b* is curved in arc-shaped such that the tip of the extended section 51*b*, which contacts the sheet feed roller 13, is spaced from the rotational shaft 13*a* of the sheet feed roller 13. With the above configuration, the plate spring 50 is configured such that the tip ends of the extended sections 51*b*, 51*b* contact the both axial ends of the sheet feed roller 13 in the neutral state (see FIG. 3).

According to the embodiments, the inclination angle of the sheet tray 7 is approximately 70 degrees with respect to a horizontal line. When the size of the recording sheet 3 is A4, the angle of the guiding sections 51*a*, 51*a* of the plate spring 50 may be within a rang from 10 to 20 degrees with respect to the horizontal line, and preferably, approximately 20 degrees with respect to the horizontal line. The inclination angle of the upper surface 42*a* of the setting section 42 may be within a range from 0 to 5 degrees, and preferably, approximately 5 degrees, with respect to the horizontal line.

Figure 7:
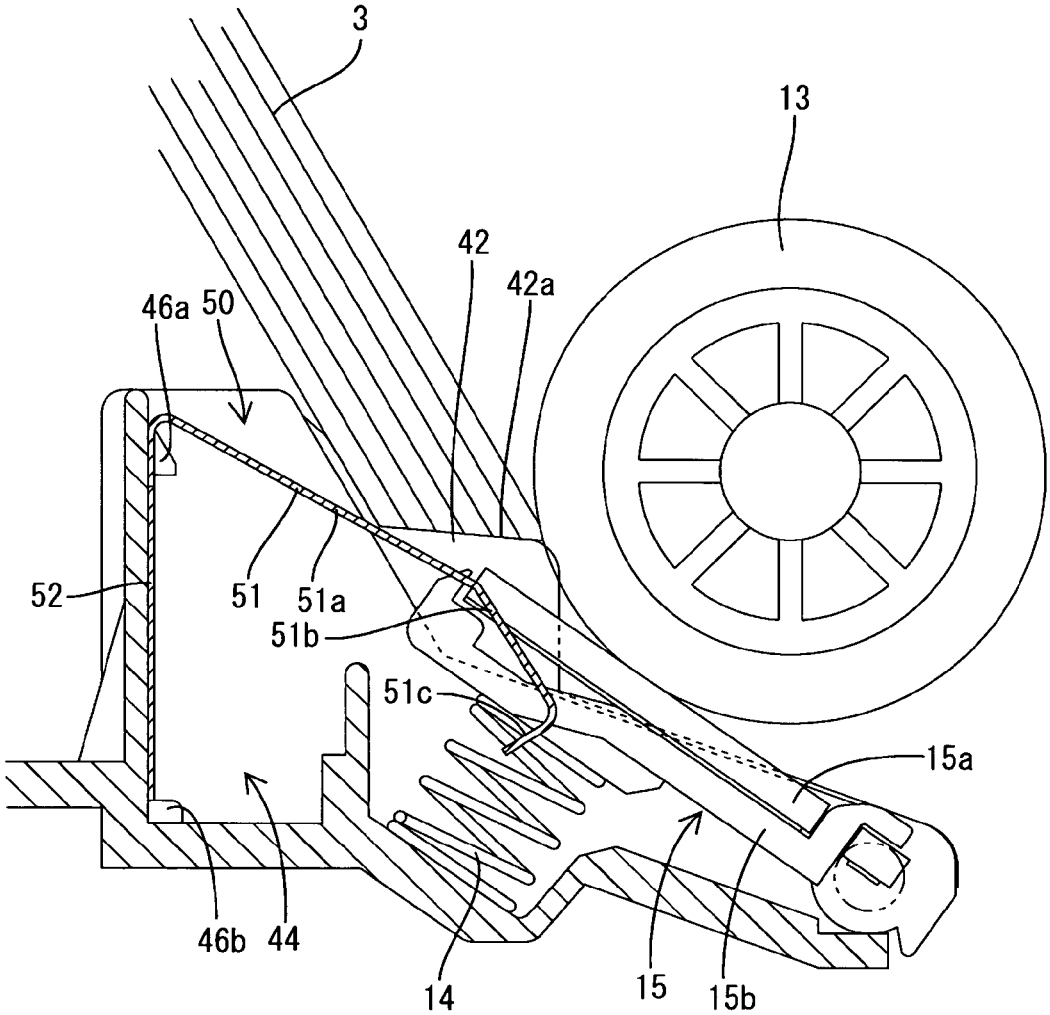
FIG. 7 is an enlarged cross-sectional view showing a status of the plate spring when the amount of stacked sheets is relatively large in accordance with aspects of the present invention.

The effects of the embodiment will be described with reference to FIGS. 6 and 7.

When a predetermined number of recording sheets 3 are mounted on the sheet tray 7, the leading ends of the recording sheets 3 are made contact the guide sections 51*a* of the plate spring 50, thereby the weight corresponding to the recording sheets 3 being applied to the guide sections 51*a*, 51*a*. With this configuration, as shown in FIG. 7, the plate spring 50 is inclined such that the downstream side end is rotated downward about the upstream side end thereof. With this inclination, the leading ends of the recording sheets 3 are made contact the upper surfaces 42*a* of the set portions 42 which have an inclination angle gentler than that of the plate spring 50. In this case, the angle at which the leading ends of the recording sheets 3 are guided is relatively gentle in comparison with a case where, as will be described below, the amount of the recording sheets 3 is small, and the urging force to the feed roller 13 is suppressed. The uppermost sheet 3 is press-contacted against the feed roller 13 with the urging force corresponding to the inclination angle of the upper surfaces 42*a* of the setting sections 42 and weight of the recording sheets 3, and the uppermost recording sheet 3 (i.e., the recording sheet 3 closet to the feed roller 13) is fed by the feed roller 13 to the contact position with the rubber member 15*a* of the separation pad 15, thereby the recording sheets 3 is introduced one by one without fail.

When the mounting amount of the recording sheets 3 on the sheet tray 7 decreases, the weight of the entire sheets 3 decreases. Then, the guiding sections 51*a*, 51*a* of the plate spring 50 return (i.e., rise) toward their neutral positions. Then, the recording sheet 3 whose leading end is located between the proximal end of the upper surfaces 42*a* of the setting sections 42 and the feed roller 13 is guided toward the feed roller 13 by the guiding sections 51*a*, 51*a* whose inclination angle is greater than the inclination angle of the upper surfaces 42*a* of the setting sections 42. With this configuration, even if the number of the recording sheets 3 is smaller, the uppermost recording sheet 3 can be guided, by the guiding sections 51*a*, 51*a* of the plate spring 50, to the feed roller 13. Then the recoding sheet 3 is further guided to the contacting position of the feed roller 13 and the rubber member 15*a* of the separation pad 15, thereby the recoding sheets 3 being supplied one by one.

According to the above-described embodiment, when the amount of the recording sheet 3 mounted on the sheet tray 7 is relatively large, the guiding portions 51*a* of the plate spring 50 are lowered by the weight of the recording sheets 3. Then the leading ends of the recording sheets 3 contact the upper surfaces 42*a* of the setting section 42 having a relatively gentle inclination angle and are guided to the feed roller 13. When the amount of the recording sheets 3 is relatively small, the guiding portions 51*a* of the plate spring 50 return upward, and the leading ends of the recording sheets 3 are guided at the inclination angle which is steeper than the inclination angle of the upper surfaces 42*a* of the setting section 42 toward the feed roller 13. With the above configuration, the recording sheets 3 can be supplied stably regardless of the amount of the recording sheets 3. Further, as described above, since no mechanisms for urging the sheet tray 7 are employed, the size of the entire device can be reduced.

Further, the main portion of the structure is made of the plate spring 50, which is made of a single metal plate. Therefore, the structure can be simplified, and the manufacturing cost can be reduced.

Furthermore, the pair of plate spring sections 51 and 51 of the plate spring 50 are arranged symmetrically with respect to the center, in the axial direction, of the feed roller 13. Thus, in comparison with a case where only one spring portion 51 is provided, a skew of the recoding sheet can be prevented, and the sheets 3 can be supplied stably.

If a sheet jam has occurred and the recording sheet 3 is to be drawn from the printer 100 in a direction opposite to the sheet feed direction, the extended portions 51*b* engage with the feed roller 13. With such a configuration, the plate spring portion 51 will not be deformed largely. Further, in the holder 15*b* of the sheet separation pad 15, which is urged toward the feed roller 13, a rubber member 15*a* having relatively large frictional resistance is provided. Therefore, if the sheet 3 is fed such that its leading end is curled, the leading end of the sheet 3 may be caught thereat due to the frictional resistance between the sheet 3 and the rubber member 15*a*, which may cause a sheet jam. To avoid the sheet jam, according to the first embodiment, the leading end of the sheet 3 is flattened with the spring member 50, which has a relatively low frictional resistance and the feed roller 13 before the sheet 3 is introduced to the separating pad 15. Therefore, even when the rubber member 15*a* is employed, the sheet jam can be suppressed well. Such a structure is particularly effective when the amount of the recording sheets 3 is relatively low.

The downstream side end of the plate spring 50 is formed to be bent in a direction away from the rotation shaft of the feed roller 13. Therefore, the downstream portion of spring sections 51 will not engage with the sheet 3 when the sheet 3 is pulled in the sheet feed direction. Such a configuration ensures that the plate spring portions 51 will not be deformed by the feeding movement of the recording sheets 3.

Second Embodiment

Figure 8:
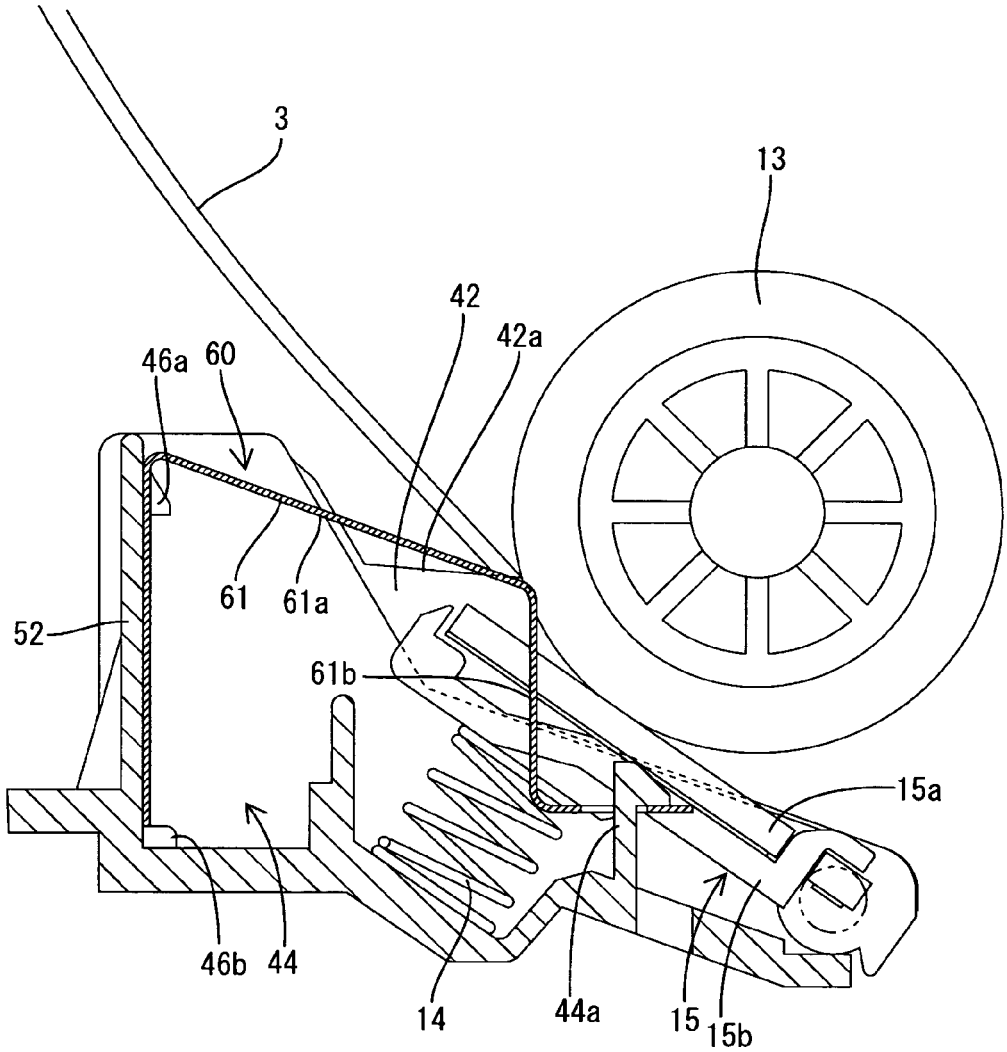
FIG. 8 is an enlarged cross-sectional view showing a status of the plate spring, according to a second embodiment, when the amount of stacked sheets is relatively small in accordance with aspects of the present invention.
Figure 9:
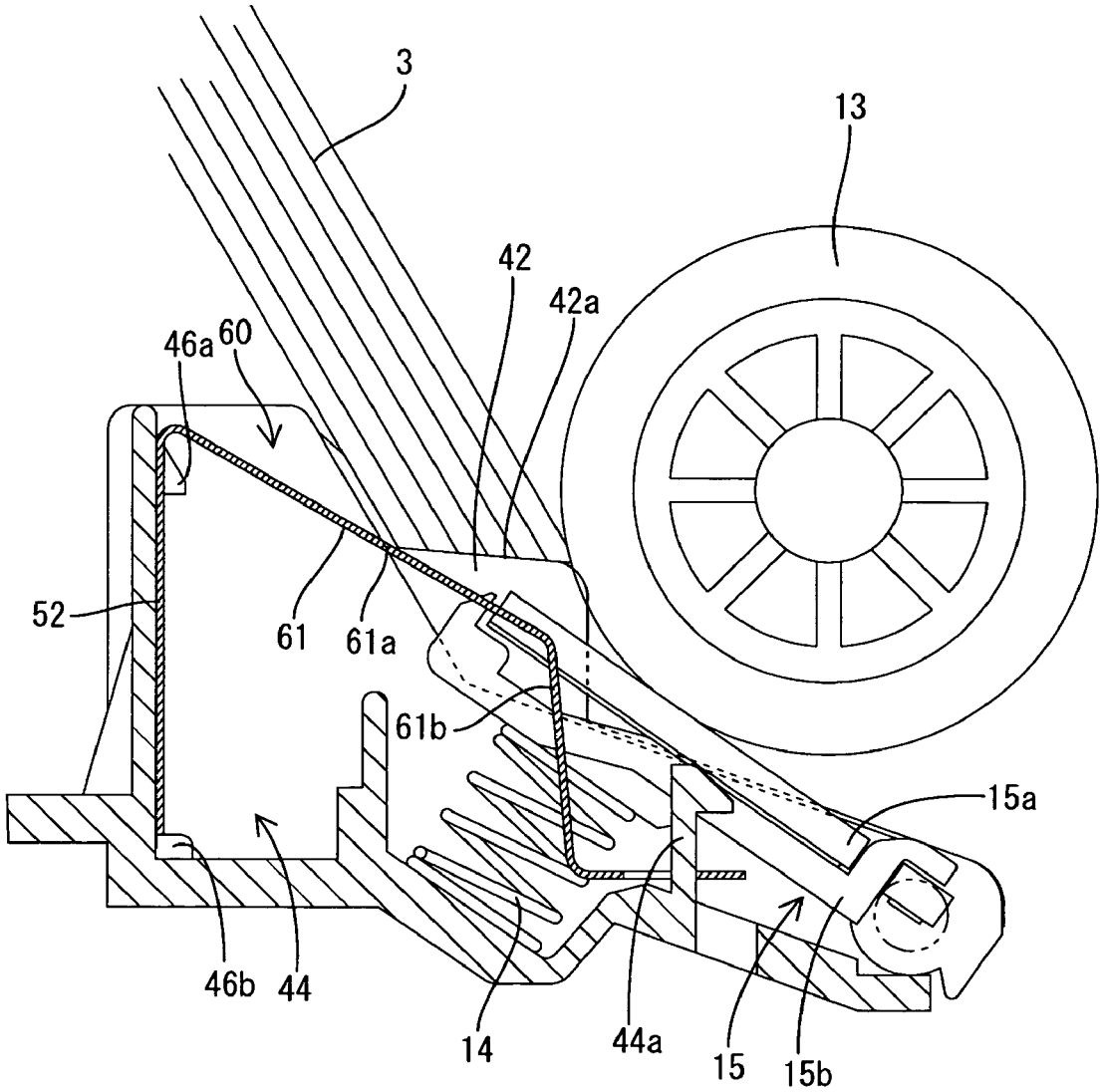
FIG. 9 is an enlarged cross-sectional view showing a status of the plate spring, according to the second embodiment, when the amount of stacked sheets is relatively large in accordance with aspects of the present invention.

FIGS. 8 and 9 show cross-sectional side views of a portion around the feed roller 13 according to the second embodiment. The one difference between the first and second embodiments is the shape of the plate spring, and the other configuration of the second embodiment is substantially the same as the first embodiment. Therefore, in FIGS. 8 and 9, elements same as those of the first embodiment are given the same reference numbers and description thereof will be omitted or simplified in the following description of the second embodiment.

In the second embodiment, instead of the plate spring 50, a modified plate spring 60 is employed. As shown in FIG. 8, the plate spring 60 has spring sections 61, which are formed such that, when viewed along the rotational axis of the feed roller 13, downstream side ends of guiding sections 61*a* extend to position where nips are formed by the feed roller 13 and the tip ends of the set sections 42. That is, the recording sheet 3 is nipped between the feed roller 13 and the downstream side ends of the guiding sections 61*a* of the plate spring 60. The plate spring 60 has extended sections 61*b* which are connected with and extended from the guiding sections 61*a*, respectively. The extended sections 61*b* are bent, at the portion connected with the guiding sections 61*a*, such that the extended sections 61*b* are directed away from the feed roller 13. Further, the tip portions of the extended sections 61*b* are bent in the sheet feed direction. As shown in FIG. 8, engaging members 44*a* are formed on the bottom surface of the sheet feed unit 40. The engaging members 44*a* restrict the upward movement of the tip end portions.

According to the second embodiment, even if the amount of the recording sheets 3 is relatively small, by the inclination of the guiding sections 61*a*, which extend to contact the feed roller 13, it is ensured that the uppermost recording sheet 3 contacts the feed roller.

Further, according to the second embodiment, the upward movement of the extended sections 61*b* is restricted by the engagement between the tip end portions of the extended sections 61*b* with the engaging members 44*a*. With this configuration, when, for example, a jammed sheet 3 is drawn in the direction opposite to the sheet feed direction, the plate spring member 60 will not be deformed largely.

Third Embodiment

Figure 10:
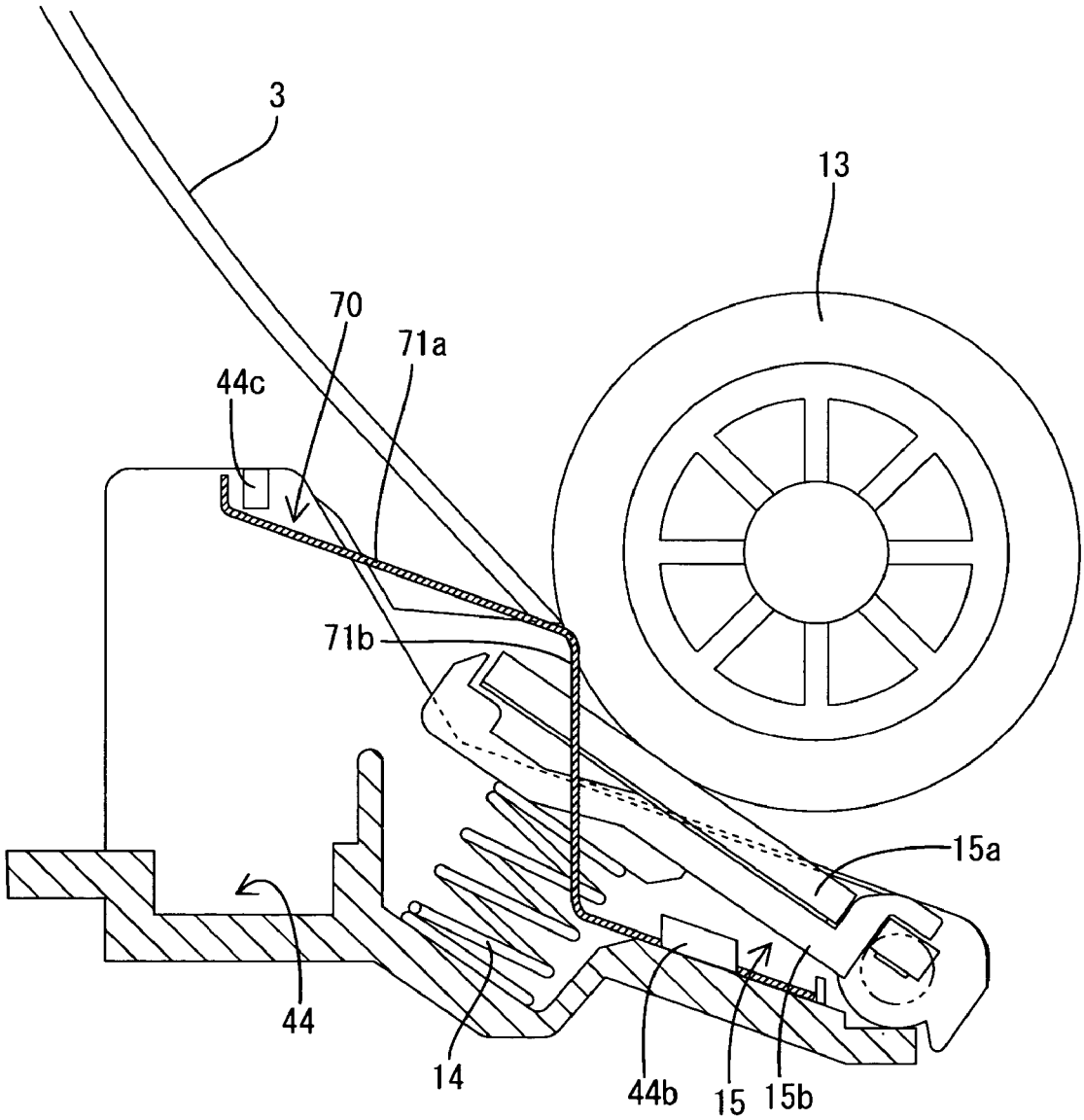
FIG. 10 is an enlarged cross-sectional view showing a status of the plate spring, according to a third embodiment, when the amount of stacked sheets is relatively small.

FIG. 10 shows a cross-sectional side view about the feed roller 13 according to a third embodiment. According to the third embodiment, the downstream side end of the plate spring section is fixed to the unit 40, while the upstream side end of the plate spring can move freely. The other configuration is substantially the same as that of the first embodiment. Therefore, the components same as those of the first embodiment are assigned with the same reference numbers referred to in the first embodiment and description thereof will be omitted.

As shown in FIG. 10, according to the third embodiment, a plate spring 70 is provided. The plate spring 70 includes guiding sections 71*a* on which the leading end of the recording sheets 3 are abutted. The upstream side ends of the guiding sections 71*a* are configured to be free ends (i.e., movable ends). The guiding sections 71*a* obliquely extend such that the downstream side ends of the guiding sections 71*a* contact the feed roller 13. An extended portion 71*b* connected from the guiding sections 71*a* is bent at the connected position in a direction in which the extended portion 71*b* located away from the feed roller 13. The downstream side end of the extended portion 71*b* is fixed on the bottom surface of the unit 40 by the fixing section 44*b*. With this configuration, according to the third embodiment, the upstream side end of the guiding sections 71*a* deform to be displaced downward by the recording sheets 3 with the downstream side end being a supporting point. In this embodiment, engaging portions are formed on an upper inner surface of the unit 40 to restrict the upward movement of the guiding sections 71*a*.

According to the third embodiment, when the amount of the recording sheets 3 is relatively large, the guide sections 71*a* are deformed to be displaced downward, thereby the inclination angle thereof becoming gentle. When the amount of the recording sheets 3 is relatively small, the inclination angle of the guiding sections 71*a* is steep. Therefore, the inclination angle varies depending on the amount of the recording sheets 3, and it is ensured that the uppermost sheet 3 of the mounted recording sheets 3 contact the feed roller irrespective of the amount of the recording sheets 3.

In the third embodiment described above, the downstream side ends of the guiding sections 71*a* are extended to contact the feed roller 13. The invention need not be limited to such a configuration, and the downstream side ends of the guiding sections 71*a* may not contact the feed roller 13 as the guiding sections 51*a* of the first embodiment.

MODIFICATIONS

It should be noted that the invention need not be limited to the above-described illustrative embodiments, but various modifications can be made without departing from the scope of the invention.

In the above-described embodiments, the guiding sections are formed by a pair of plate springs. This configuration can be modified such that, for example, the guiding sections include three or more plate springs.

The guiding sections may be formed by resin plates (preferably having lower frictional resistance than the rubber member) and an urging mechanism (e.g., a rubber member or spring member) configured to urge the resin plates toward the feed roller 13.

In the above-described embodiment, movement restriction members for restricting the upward movement of the extended portions 51*b* may optionally be provided.

What is claimed is:

1. A sheet supplying device for an imaging apparatus, comprising:

a sheet tray configured to mount a plurality of sheets in a stacked state, the sheet tray being inclined such that leading ends, in a sheet feed direction, of the plurality of sheets are lower than trailing ends of the plurality of sheets;

a feed roller that faces an uppermost sheet of the plurality of sheets mounted on the sheet tray to be press-contacted to the uppermost sheet, the feed roller being driven to rotate to feed the uppermost sheet; and a sheet guide mechanism having at least one guiding section provided upstream of the feed roller, the guiding section extending in the sheet feed direction, the guiding section being inclined such that the leading ends of the plurality of sheets are moved toward the feed roller by their own weight, the guiding section including a fixed guide surface unmovable with respect to the feed roller and a movable guide surface, wherein the degree of inclination of the movable guide surface, which is larger than a degree of inclination of the fixed guide surface, varies depending on the amount of the plurality of sheets on the sheet tray, and the uppermost sheet of the sheets on the sheet tray is guided to contact the feed roller with the movable guide surface when a first amount of sheets is on the sheet tray, and the uppermost sheet is guided to contact the feed roller with the fixed guide surface when a second amount of sheets that is larger than the first amount is on the sheet tray.

2. The sheet supplying device according to claim 1, wherein the sheet guide mechanism includes a plurality of the guiding sections arranged in a sheet width direction which is a direction perpendicular to the sheet feed direction.

3. The sheet supplying device according to claim 2, wherein the plurality of guiding sections include one or more pair of guiding sections all facing the feed roller.

4. The sheet supplying device according to claim 2, wherein the plurality of guiding sections are arranged substantially symmetrically with respect to a center, in an axial direction, of the feed roller.

5. The sheet supplying device according to claim 1, wherein the movable guide surface of the guiding section includes: a plate spring having an upstream side end and a downstream side end in the sheet feed direction, the plate spring being inclined such that the downstream side end is lower than the upstream side end, the plate spring being supported to be rockable about the upstream side end portion thereof and the fixed guide surface has a gentler inclination than the plate spring, a downstream end of the guide surface overlapping with a circumferential surface of the feed roller when viewed in the axial direction of the feed roller.

6. The sheet supplying device according to claim 5, wherein the plate spring includes a guiding portion and an extended portion, the guiding portion extending toward the feed roller, from the upstream end of the plate spring to a front of the feed roller, the leading ends of the sheets being abut to the guiding portion from the above, the extended portion connected from a downstream side end of the guiding portion and extending in a downstream side in the sheet feed direction.

7. The sheet supplying device according to claim 6, wherein the extended portion is bent with respect to the guiding portion such that a portion on downstream side of the extended portion is farther from the feed roller.

8. The sheet supplying device according to claim 5, wherein the plate spring includes a guiding portion extending toward the feed roller, from the upstream end of the plate spring to a position where the downstream end of the guide surface overlaps with the circumferential surface of the feed roller when viewed in the axial direction of the feed roller, the leading ends of the sheets being abut to the guiding portion from the above, the extended portion connected from a downstream side end of the guiding portion and extending in a downstream side in the sheet feed direction.

9. The sheet supplying device according to claim 5, wherein the guiding section includes a restriction mechanism that engages with the downstream side portion of the plate spring to restrict a rocking movement of the plate spring such that the plate spring does not move closer to the feed roller exceeding a predetermined position which is a position the plate spring is located when no sheets are mounted on the sheet tray.

10. The sheet supplying device according to claim 1, wherein the movable guide surface inclines such that a downstream side end, in the sheet feeding direction, is lower than an upstream side end.

11. The sheet supplying device according to claim 10, wherein the movable guide surface is configured to rock about the downstream side end thereof.

12. The sheet supplying device according to claim 10, wherein the movable guide surface is configured to rock about the upstream side end thereof.

13. The sheet supplying device according to claim 1, wherein the movable guide surface is configured to rock such that a downstream side is lowered by the weight of the sheets whose leading ends contact the movable guide surface; and the fixed guide surface having a predetermined inclination, the leading end of the sheets contacting the fixed guide surface as the downstream side of the movable guide surface is lowered.

14. An imaging device configured to at least one of read and print image on sheets, the imaging device comprising a sheet supplying device that feeds the sheets in the imaging device which is provided with:

a sheet tray configured to mount a plurality of sheets in a stacked state, the sheet tray being inclined such that leading ends, in a sheet feed direction, of the plurality of sheets are lower than trailing ends of the plurality of sheets;

a feed roller that faces an uppermost sheet of the plurality of sheets mounted on the sheet tray to be press-contacted to the uppermost sheet, the feed roller being driven to rotate to feed the uppermost sheet; and a sheet guide mechanism having at least one guiding section provided upstream of the feed roller, the guiding section extending in the sheet feed direction, the guiding section being inclined such that the leading ends of the plurality of sheets are moved toward the feed roller by their own weight, the guiding section including a fixed guide surface unmovable with respect to the feed roller and a movable guide surface, wherein the degree of inclination of the movable guide surface, which is larger than a degree of inclination of the fixed guide surface, varies depending on the amount of the plurality of sheets on the sheet tray, wherein the uppermost sheet of the sheets on the sheet tray is guided to contact the feed roller with the movable guide surface when a first amount of sheets is on the sheet tray, and the uppermost sheet is guided to contact the feed roller with the fixed guide surface when a second amount of sheets that is larger than the first amount is on the sheet tray.

15. A sheet supplying device for an imaging apparatus comprising:

a sheet tray configured to mount a plurality of sheets in a stacked state, the sheet tray being inclined such that the leading ends, in a sheet feed direction, of the plurality of sheets are lower than trailing ends of the plurality of sheets, a feed roller that faces an uppermost sheet of the plurality of sheets mounted on the sheet tray to be pressed-contacted to the uppermost sheet, the feed roller being driven to rotate to feed the uppermost sheet; and a sheet guide mechanism having at least one guiding section provided upstream of the feed roller, the guiding section extending in the sheet feed direction, the guiding section being inclined such that the leading ends of the plurality of sheets are moved toward the feed roller by their own weight, the guiding section including a fixed guide surface unmovable with respect to the feed roller and a movable guide surface, wherein the degree of inclination of the movable guide surface, which is larger than a degree of inclination of the fixed guide surface, varies depending on the amount of the plurality of sheets on the sheet tray, and the uppermost sheet of the sheets on the sheet tray is guided to contact the feed roller with the movable guide surface when a first amount of sheets is on the sheet tray, and the uppermost sheet is guided to contact the feed roller with the fixed guide surface when a second amount of sheets that is larger than the first amount is on the sheet tray, wherein a downstream end of the movable guide surface overlaps with a circumferential surface of the feed roller when viewed in the axial direction of the feed roller.

* * * * *